US010092091B1

(12) United States Patent
Wang et al.

(10) Patent No.: US 10,092,091 B1
(45) Date of Patent: Oct. 9, 2018

(54) PLASTIC TABLE BOARD

(71) Applicants: Youjie Wang, Xiaoshan (CN); Zefan Wang, Xiaoshan (CN)

(72) Inventors: Youjie Wang, Xiaoshan (CN); Zefan Wang, Xiaoshan (CN)

( * ) Notice: Subject to any disclaimer, the term of this patent is extended or adjusted under 35 U.S.C. 154(b) by 0 days.

(21) Appl. No.: 15/720,716

(22) Filed: Sep. 29, 2017

(30) Foreign Application Priority Data

Aug. 1, 2017 (CN) ..... 2017 2 0948189 U

(51) Int. Cl.
*A47B 13/02* (2006.01)
*A47B 13/08* (2006.01)
*A47B 13/00* (2006.01)

(52) U.S. Cl.
CPC ..... *A47B 13/083* (2013.01); *A47B 13/003* (2013.01); *A47B 13/02* (2013.01)

(58) Field of Classification Search
CPC ..... Y10T 428/24694; Y10T 428/24628; B32B 2/28; B32B 3/30; A47B 13/083; A47B 13/003; A47B 13/02; A47B 13/08; A47B 2013/085
USPC ..... 52/782.2, 796.11, 796.12, 793.1, 783.19; 108/161, 27, 129–133, 901
See application file for complete search history.

(56) References Cited

U.S. PATENT DOCUMENTS 3,340,649 A * 9/1967 Erlandsen ..... E06B 5/01 49/367
3,425,077 A * 2/1969 Sievers ..... E01D 19/125 14/73
5,443,020 A * 8/1995 Price ..... A47B 3/0912 108/115
5,983,807 A * 11/1999 Tarnay ..... A47B 3/0912 108/131
6,058,853 A * 5/2000 Pinch ..... A47B 3/087 108/129
6,058,854 A * 5/2000 Tarnay ..... A47B 3/08 108/161
7,905,185 B2 * 3/2011 Peery ..... A47B 3/0912 108/132
8,181,579 B2 * 5/2012 Leng ..... A47B 13/086 108/161
8,397,652 B2 * 3/2013 Peery ..... A47B 7/02 108/132

(Continued)

FOREIGN PATENT DOCUMENTS

WO 2017045579 * 3/2017

OTHER PUBLICATIONS

CN 205410405 drawing and abstract (Year: 2016).*

*Primary Examiner* — Janet Marie Wilkens
(74) *Attorney, Agent, or Firm* — Jiwen Chen

(57) ABSTRACT

A plastic table board includes a top panel and a reinforced frame, wherein an edge of the top panel is equipped with a downward-extending side edge, the reinforced frame is located below the top panel, an outside edge of the reinforced frame is closely adhered to the side edge of the top panel; the outside edge of the reinforced frame is provided with a first plane, a connecting surface and a second plane, the connecting surface is an inward-bent cambered surface for connecting the first plane and the second plane; the first plane and the side edge of the top panel are located at a same vertical plane, the second plane is fixed with an inner wall of the side edge of the top panel, and a bottom end of the side edge of the top panel is located above the connecting surface.

1 Claim, 2 Drawing Sheets

(56) References Cited

U.S. PATENT DOCUMENTS

| | | | | |
|---|---|---|---|---|
| 8,534,029 | B2 * | 9/2013 | Leng | A47B 13/08 52/783.1 |
| 8,846,176 | B2 * | 9/2014 | Leng | B32B 3/12 428/116 |
| 9,867,458 | B2 * | 1/2018 | Leng | A47B 13/083 |
| 2008/0092788 | A1 * | 4/2008 | Leng | A47B 21/00 108/159 |
| 2009/0324872 | A1 * | 12/2009 | Leng | A47B 13/08 428/73 |
| 2017/0325581 | A1 * | 11/2017 | Leng | A47B 13/083 |

* cited by examiner

PLASTIC TABLE BOARD

This application claims the priority benefit of Chinese Application No. 2017209481896, filed Aug. 1, 2017, which is hereby incorporated by reference.

TECHNICAL FIELD

The present invention relates to a plastic table board structure, and more particularly, to a plastic table board.

BACKGROUND ART

A plastic table board has gradually improved to a light structure of the current double-layer plastic sheet from a heavy structure of an early single-layer solid plastic board. That is to say, an upper panel and a lower bottom board are overlapped and bonded together. Moreover, edges of the top panel are usually provided with downward extending sides to cover edges of the lower bottom board, in order not for people to see the bonding traces of the top panel and the lower bottom board in appearance. In the use of the existing plastic table board, the clothing is often hooked by the side edge of the top panel. It is easy to hook and break the clothing. If a greater force is applied, the side edge of the top panel is directly broken off. In addition, the lower edge of the side edge of the top panel is sharper, easy to scratch fingers.

SUMMARY OF THE INVENTION

The present invention aims at providing a plastic table board capable of avoiding edges of the table board from scraping user's clothing.

For this purpose, the technical solution of the present invention is as follows: a plastic table board comprises a top panel and a reinforced frame, wherein an edge of the top panel is equipped with a downward-extending side edge, the reinforced frame is located below the top panel, an outside edge of the reinforced frame is closely adhered to the side edge of the top panel; the outside edge of the reinforced frame is provided with a first plane, a connecting surface and a second plane, the connecting surface is an inward-bent cambered surface for connecting the first plane and the second plane; the first plane and the side edge of the top panel are located at a same vertical plane, the second plane is glued and fixed with an inner wall of the side edge of the top panel, a bottom end of the side edge of the top panel is located above the connecting surface, the bottom end of the side edge of the top panel is bent towards one side of the second plane to form a blocking end, the outside of the blocking end is a circular arc chamfer, the inside thereof is supported against the second plane, a lower bottom board is further arranged below the top panel, the edge of the lower bottom board is fixed between the top surface of the reinforced frame and the top panel, one side of the lower plane facing toward the top panel is provided with a plurality of raised lug bosses, and the lug bosses support the top panel.

Further, the edge of the top panel is provided with a downward-inclined slope, the slope is connected with the side edge of the top panel; the edge of the lower bottom board is located between the top surface of the reinforced frame and the top panel, the edge of the lower bottom board is further provided with a second lug boss, and the second lug boss supports the top panel to form the slope.

In the present invention, an outside surface of the plastic-sprayed metal reinforced frame is changed into the first plane and the second plane that are staggered at the vertical plane from the common plane, so that the first plane corresponds to the position of the side edge of the top panel, and the second plane is further fixed with the inner wall of the side edge of the top panel, so that the bottom end of the side edge of the top panel is located above the connecting surface between the first plane and the second plane. Moreover, the smooth first plane corresponds to below the side edge of the top panel, thereby blocking clothing and finger from hooking the side edge of the top panel. Meanwhile, the second plane of the reinforced frame is fixed with the side edge of the top panel, which improves the stability of the both, and prolongs the service life of the table board.

BRIEF DESCRIPTION OF THE DRAWINGS

The present invention is further described in details hereinafter by reference to the drawings and the exemplary embodiments of the present invention.

Figure 1:
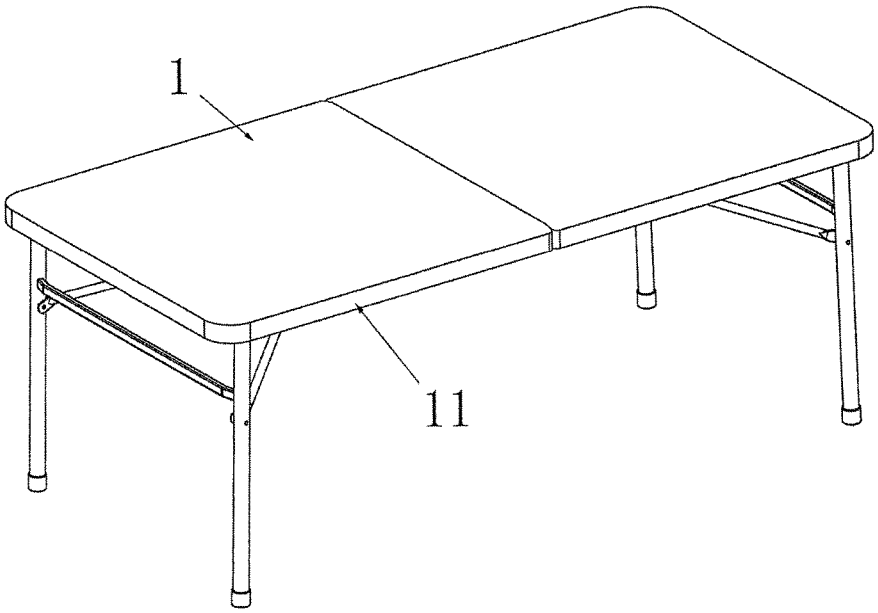
FIG. 1 is a schematic diagram of a massive structure of the present invention.
Figure 2:
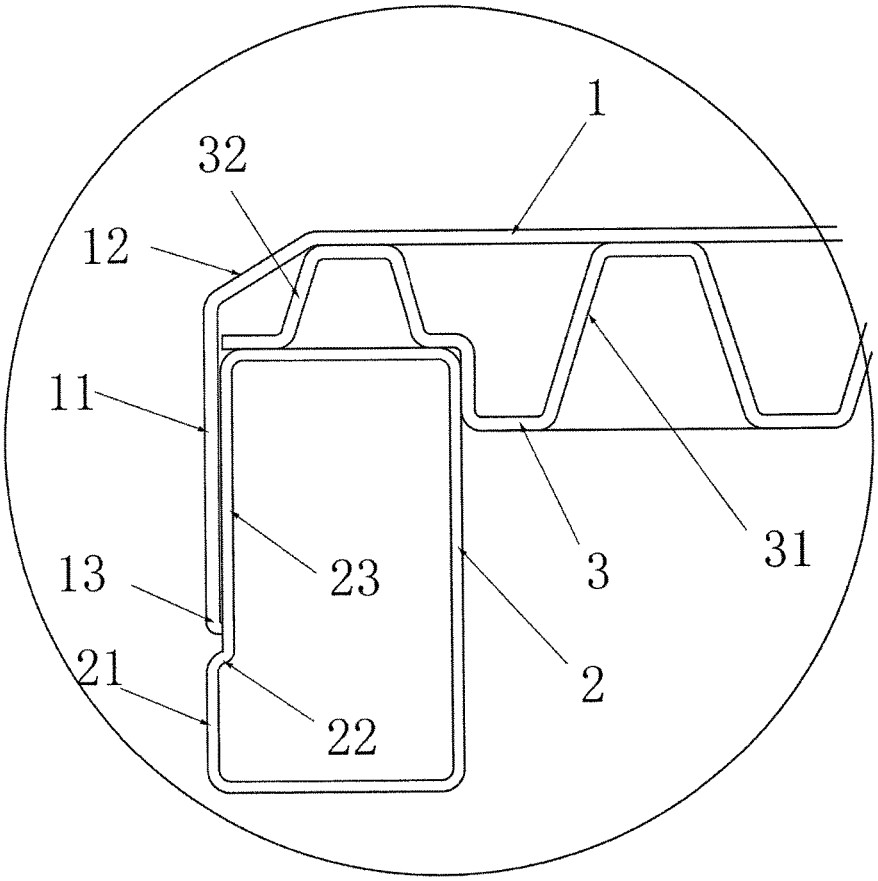
FIG. 2 is a schematic diagram of a first structure of the present invention.

Marks in drawings: top panel 1, side edge 11, slope 12, blocking end 13, reinforced frame 2, first plane 21, connecting surface 22, second plane 23, lower bottom board 3, lug boss 31, second lug boss 32.

DETAILED DESCRIPTION OF THE PREFERRED EMBODIMENTS

Referring to the drawings, this embodiment comprises a top panel 1 and a reinforced frame 2, wherein an edge of the top panel 1 is equipped with a downward-extending side edge 11, the reinforced frame 2 is located below the top panel 1, an outside edge of the reinforced frame 2 is closely adhered to the side edge 11 of the top panel; the outside edge of the reinforced frame is provided with a first plane 21, a connecting surface 22 and a second plane 23, the connecting surface 22 is an inward-bent cambered surface for connecting the first plane 21 and the second plane 23; the first plane 21 and the side edge 11 of the top panel are located at a same vertical plane, the second plane 23 is glued and fixed with an inner wall of the side edge 11 of the top panel, a bottom end of the side edge 11 of the top panel is located above the connecting surface 22, the bottom end of the side edge 11 of the top panel is bent towards one side of the second plane 23 to form a blocking end 13, the outside of the blocking end is a circular arc chamfer, the inside thereof is supported against the second plane; a lower bottom board 3 is further arranged below the top panel, the edge of the lower bottom board is flat and fixed between the top surface of the reinforced frame 2 and the top panel 1, one side of the lower bottom board facing toward the top panel is provided with a plurality of raised lug bosses 31, the lug bosses 31 support the top panel 1, and the lug bosses 31 is glued and fixed with the top panel 1.

The reinforced frame is made of metal, the surface thereof is subjected to plastic-sprayed treatment, the second plane at the outside edge of the reinforced frame is bonded with the side edge of the top panel via hot melt glue, the top surface of the reinforced frame is fixed with one side of a back surface of the edge of the lower bottom board, and the top surface of the edge of the lower bottom board is fixed with the lower part of the top panel as a whole.

Figure 3:
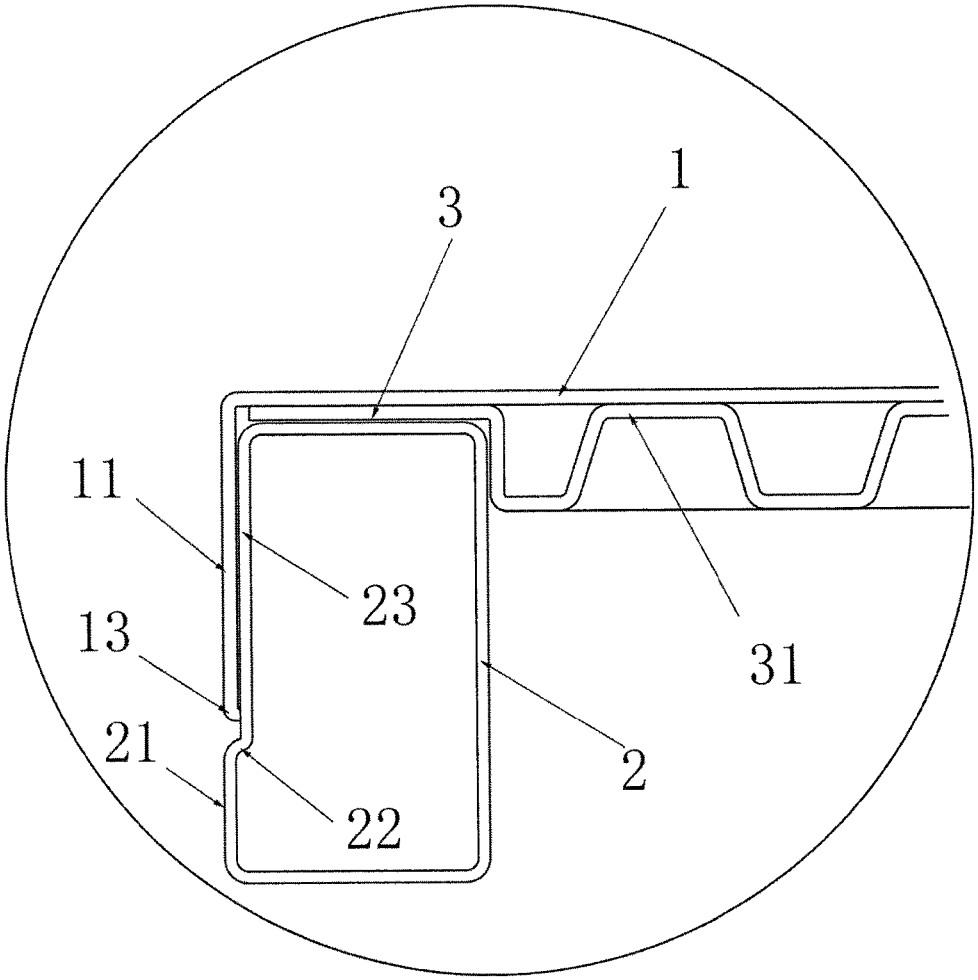
FIG. 3 is a schematic diagram of a second structure of the present invention.

As shown in FIG. 3, the edge of the top panel in the second table board structure is provided with a downward-inclined slope 12, the slope 12 is connected with the side edge 11 of the top panel; the edge of the lower bottom board is located between the top surface of the reinforced frame 2 and the top panel 1, the edge of the lower bottom board 3 is further provided with a smaller second lug boss 32, the second lug boss 32 supports the top panel 1 to form the slope 12, and the second lug boss 32 is also glued and fixed with the top panel 1.

The reinforced frame is made of metal, the surface thereof is subjected to plastic-sprayed treatment, the second plane 23 at the outside edge of the reinforced frame 2 is bonded with the side edge 11 of the top panel via hot melt glue, the top surface of the reinforced frame 2 is fixed with one side of the lower bottom board 3 back on to the top panel, that is the plane surrounding the second lug boss, the protruded top surface of the second lug boss is fixed with the top panel, the second lug boss enables the top panel to support the downward-inclined slope 12 at the edge, and corners of the table board are subjected to chamfer treatment.

The invention claimed is:

1. A plastic table board, comprising a top panel and a reinforced frame, wherein an edge of the top panel is equipped with a downward-extending side edge, the reinforced frame is located below the top panel, an outside edge of the reinforced frame is closely adhered to the side edge of the top panel; the outside edge of the reinforced frame is provided with a first plane, a connecting surface and a second plane, the connecting surface is an inward-bent cambered surface for connecting the first plane and the second plane; the first plane and the side edge of the top panel are located at a same vertical plane, the second plane is glued and fixed with an inner wall of the side edge of the top panel, a bottom end of the side edge of the top panel is located above the connecting surface, the bottom end of the side edge of the top panel is bent towards one side of the second plane to form a blocking end, the outside of the blocking end is a circular arc chamfer, the inside thereof is supported against the second plane, a lower bottom board is further arranged below the top panel, the edge of the lower bottom board is fixed between the top surface of the reinforced frame and the top panel, one side of the lower plane facing toward the top panel is provided with a plurality of raised lug bosses, and the lug bosses support the top panel, wherein the edge of the top panel is provided with a downward-inclined slope, the slope is connected with the side edge of the top panel; the edge of the lower bottom board is located between the top surface of the reinforced frame and the top panel, the edge of the lower bottom board is further provided with a second lug boss, and the second lug boss supports the top panel to form the slope.

* * * * *